US005189792A

United States Patent [19]

Otsuka et al.

[11] Patent Number: 5,189,792

[45] Date of Patent: Mar. 2, 1993

[54] RECIPROCATORY ELECTRIC SHAVER

[75] Inventors: Kiyotaka Otsuka; Kenzo Shirakawa; Masakazu Kita; Masao Tanahashi, all of Hikone; Jyuzaemon Iwasaki, Nagahama, all of Japan

[73] Assignee: Matsushita Electric Works, Ltd., Osaka, Japan

[21] Appl. No.: 807,591

[22] Filed: Dec. 16, 1991

[30] Foreign Application Priority Data

Dec. 20, 1990 [JP] Japan ..... 2-404527
Dec. 20, 1990 [JP] Japan ..... 2-404528
Mar. 1, 1991 [JP] Japan ..... 3-36103

[51] Int. Cl.[5] ..... B26B 19/02; B26B 19/44; B26B 19/12

[52] U.S. Cl. ..... 30/43.92; 30/41.6; 30/43.8

[58] Field of Search ..... 30/43.92, 43.1, 43.3, 30/41.6, 34.1, 43.8

[56] References Cited

U.S. PATENT DOCUMENTS 3,339,276 9/1967 Tolmie et al. ..... 30/43.92
3,931,675 1/1976 Czerner ..... 30/43.92
4,031,617 6/1979 Tanaka et al. ..... 30/41.6
4,292,737 10/1981 Packham ..... 30/43.92 X
4,796,359 1/1989 Oprach et al. .
4,797,997 1/1989 Packham et al. ..... 30/43.92
4,837,929 6/1989 Tanahashi et al. .
4,930,217 6/1990 Wolf et al. .

*Primary Examiner*—Douglas D. Watts
*Assistant Examiner*—Paul M. Heyrana, Sr.
*Attorney, Agent, or Firm*—Stevens, Davis, Miller & Mosher

[57] ABSTRACT

A reciprocatory cutter head includes a pair of cutter heads mounted to a head frame. Each of the cutter heads is of elongated configuration extending horizontally to define a longitudinal axis and have opposed longitudinal ends. The cutter head includes an elongated outer shearing foil which comes into hair shearing engagement with an inner cutter driven to reciprocate along the longitudinal axis. The cutter heads are floatingly supported to the head frame in such a manner that the cutter heads are vertically movable relative to the head frame independently from each other as well as that each of the cutter heads is vertically movable at one longitudinal end substantially independently of the other longitudinal end. Whereby, the cutter heads cooperate with each other to readily conform to the shapes of a user's skin with maximum skin engaging area for assuring enhanced shaving performance, particularly at the irregularly contoured portions of the skin.

10 Claims, 14 Drawing Sheets

58
6
3
2
30
26
20
70

85
86
86
84
23
22
24
80
12
12
16
10
14
14
15
15
13
18
18
19

58B
58B
50B
53B
50B
53B
57B
31B
37B
60B
34B
38B
41B
31B
3B
66B
61B
41B
6B

RECIPROCATORY ELECTRIC SHAVER

BACKGROUND OF THE INVENTION

1. Field of the Invention

The present invention is directed to a reciprocatory electric shaver, and more particularly, to a reciprocatory electric shaver having more than one cutter head.

2. Description of the Prior Art

Recently, there have been proposed shavers having more than one cutter heads in an attempt to effect simultaneous shaving at different portions of the user's skin. Thus, the shaver provides for more than one engaging portion of the cutter head against the user's skin for improved shaving efficiency. However, the cutter heads may sometimes fail to follow an intricate three-dimensional contour of the skin in constant engaging relation with the skin. In order to avoid this problem, U.S. Pat. No. 4,796,359 proposes a pivoted shearing head system with a parallel pair of elongated cutter heads. The cutter heads are so linked as to pivot about a common pivot axis in order to keep the cutter heads in constant engagement with portions of the user's skin spaced in a direction perpendicular to the pivot axis. This head system is found satisfactory when moving the cutter heads across the skin of relatively flat configuration where both of the cutter heads can be equally kept engaged with the skin over extended portions along the length of the cutter heads. However, due to the structural limitation that the two the cutter heads are movable together, there remains a problem in that, when moving the cutter heads across the skin surface of complicated surface, such as around the chin, one of the cutter head comes into engagement only at a restricted portion with the skin or even miss to follow the contour of the skin while the other cutter head is engaged with the skin over an extended portion. Consequently, the shaver of this type is found still difficult to improve shaving efficiency in shaving the complicated portion of skin.

SUMMARY OF THE INVENTION

The above problem and insufficiency have been eliminated in the present invention which provides a reciprocatory electric shaver of improved and unique cutter head system. The electric shaver in accordance with the present invention comprises a head frame mounting more than one elongated cutter head extending horizontally to define a longitudinal axis and having opposed longitudinal ends spaced along the longitudinal axis. Each cutter head includes an elongated outer shearing foil which comes into hair shearing engagement with an inner cutter driven to reciprocate along the longitudinal axis. The characterizing feature of the head system resides in that the cutter heads are floatingly supported to the head frame in such a manner that the cutter heads are movable vertically relative to the head frame independently from each other and further that each of the cutter heads is movable vertically at one of the longitudinal ends substantially independently of the other longitudinal end. Thus, the individual cutter heads can move freely and therefore have large degrees of freedom in following the contour of the user's skin, thereby enabled to be engaged over an extended portion of each cutter head to the skin for increasing shaving efficiency.

Accordingly, it is a primary object of the present invention to provide an improved reciprocatory electric shaver with a plurality of cutter heads which are movable freely from each other and are individually allowed to follow the complicated contour of the skin for improved shaving efficiency.

Formed at the longitudinal ends of the head frame are opposed end walls which are respectively provided with spring support members which are vertically movable relative to the head frame independently from each other and are coupled to the corresponding longitudinal ends of the cutter head in a floatingly supporting relation thereto. The spring support member comprises a plurality of vertically spaced resilient beams extending horizontally from the associated end wall in substantially a parallel relation to each other and a coupler joining the free ends of the resilient beams so that the spring support member can be vertically movable relative to the end wall by resiliently deforming the resilient beams. The coupler is connected to floatingly support the corresponding longitudinal end of the cutter head. The spring support member is disposed within a thickness of the associated end wall with the coupler connected the cutter head. Thus, the spring support member can be successfully included in the head frame without adding extra dimension to an overall lengthwise dimension of the head system, thereby giving a maximum effective shearing length to the cutter head within a limited lengthwise dimension.

It is therefore another object of the present invention to provide an improved reciprocatory electric shaver in which the cutter heads can be floatingly supported by the spring support members of such configuration not to add any substantial extra dimension to the overall length of the head system.

Further, the spring support member is molded integrally with the associated end wall or the head frame so that the head frame is formed as a one-piece plastic molding including the spring support member. This reduces the number of the parts and accordingly facilitate the assembly of the head system, which is therefore a further object of the present invention.

The coupler of the spring support member is allowed to resiliently move vertically downward in a greater amount than vertically upward from a neutral position of keeping the cutter head to extend horizontally. Thus, the cutter heads can retracted in the head frame in a greater amount as a consequence of pressing the cutter heads against the skin, thereby facilitating to conform the cutter heads to the contour of the skin, which is therefore a still further object of the present invention.

The head frame is provided with a latch member for holding one of the cutter heads in a vertically lowered position from the adjacent cutter head in order to keep the one cutter head away from contacting the skin during the shaving operation. Thus, only the remaining cutter head can be made operative so as to facilitate the shaving at a restricted portion of the skin, for example, beneath the nose.

It is therefore a still further object of the present invention to provide an improved reciprocatory electric shaver in which one of the cutter head can be disabled for facilitating to shave a restricted area of the skin.

The latch member includes a slider supported on the head frame to be slidable between a first position and a second position. The slider is formed with can surfaces which are engaged with one of the cutter heads in such a manner as to vertically lower the one cutter head in response to the sliding movement of said slider from the first position to the second position and hold it into the vertically lowered or inoperative condition when the slider is at the second position. Thus, the cutter head can be readily moved to the lowered inoperative condition by simple manipulation of the slider.

These and still other objects and advantages will become more apparent from the following detailed description of the preferred embodiment of the present invention when taken in conjunction with the attached drawings.

DETAILED DESCRIPTION OF THE EMBODIMENT

Figure 1:
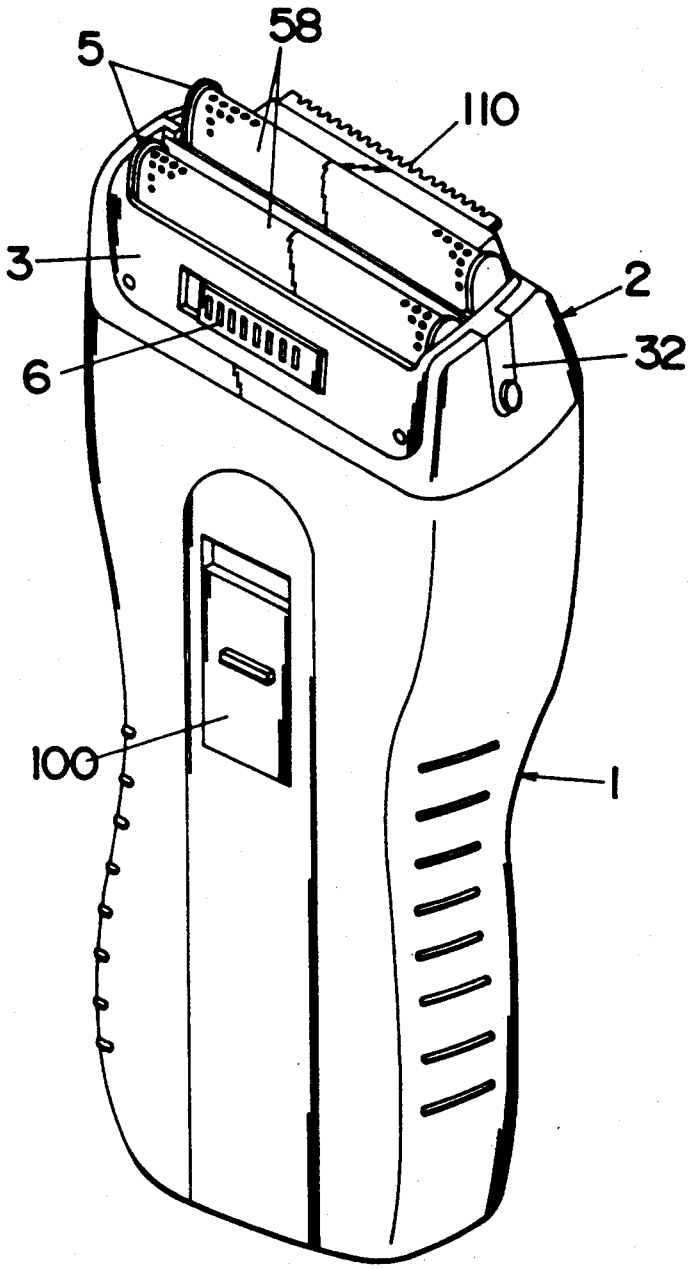
FIG. 1 is a perspective view of a reciprocatory electric shaver in accordance with a first embodiment of the present invention.

Referring now to FIGS. 1 to 4, there is shown a reciprocatory electric shaver in accordance with a preferred embodiment of the present invention. The shaver comprises a shaver housing 1 mounting thereon a shaver head 2 of dual cutter configuration having a parallel pair of elongated cutter heads 5. The shaver head 2 comprises a support frame 20 mounted on the top of the shaver housing 1 and a head frame 3 detachably supported within the support frame 20. It is by this head frame 3 that the cutter heads 5 are mounted to the support frame 20. Each cutter head 5 comprises an outer shearing foil 58 bent into a generally U-shaped configuration to have an apex which extends longitudinally of the cutter head 5 to define a longitudinal axis of the cutter head 5. As discussed later in detail, the head frame 3 is assembled into a unitary structure including the dual cutter heads 5 and is detachable to the support frame 20 as one replacement part in which the cutter heads 5 are floatingly supported. The support frame 20 is hinged at its one end by means of a hinge assembly 22 to the housing 1 so as to be easily opened. The other end of the support frame 20 is engageable with a lock finger 23 on the side of the housing 1 so as to retain the support frame 20 into a closed position on the housing 1. The engagement of the lock finger 23 with the support frame 20 can be released by simply pressing a button 24 integral with the lock finger 23.

Figure 3:
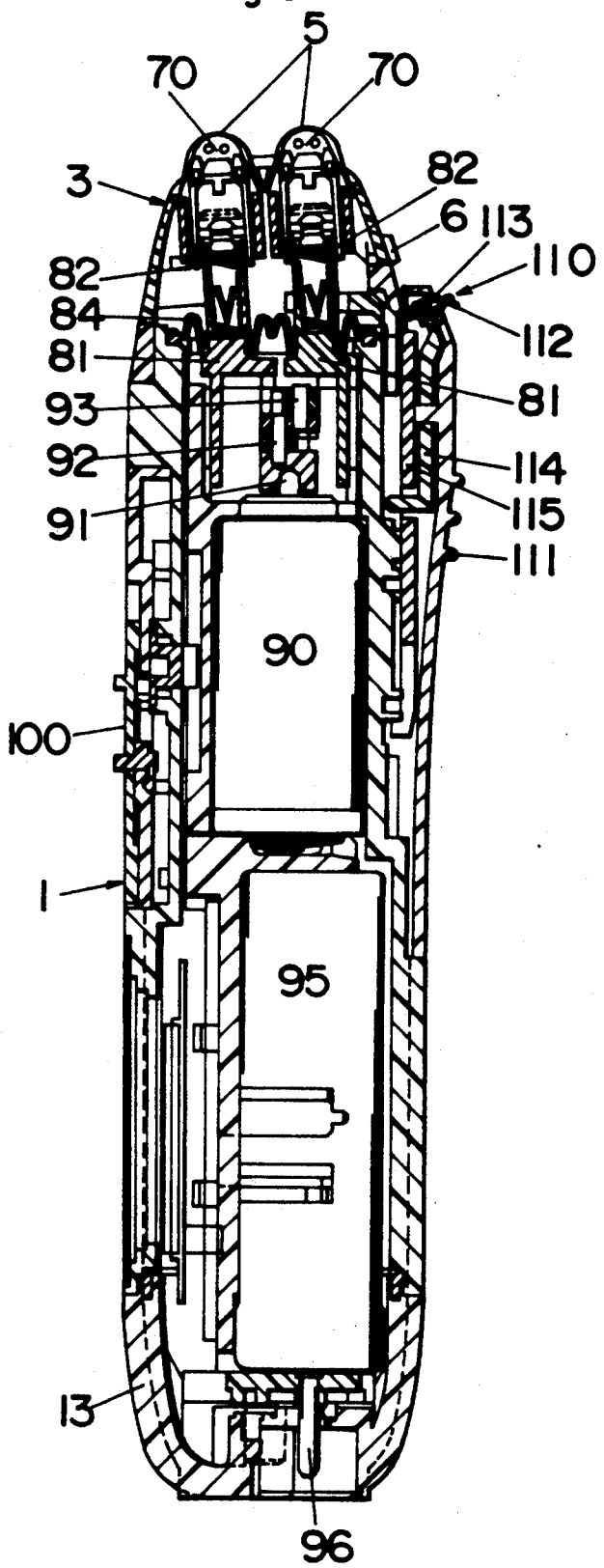
FIG. 3 is a vertical side section of the shaver.
Figure 4:
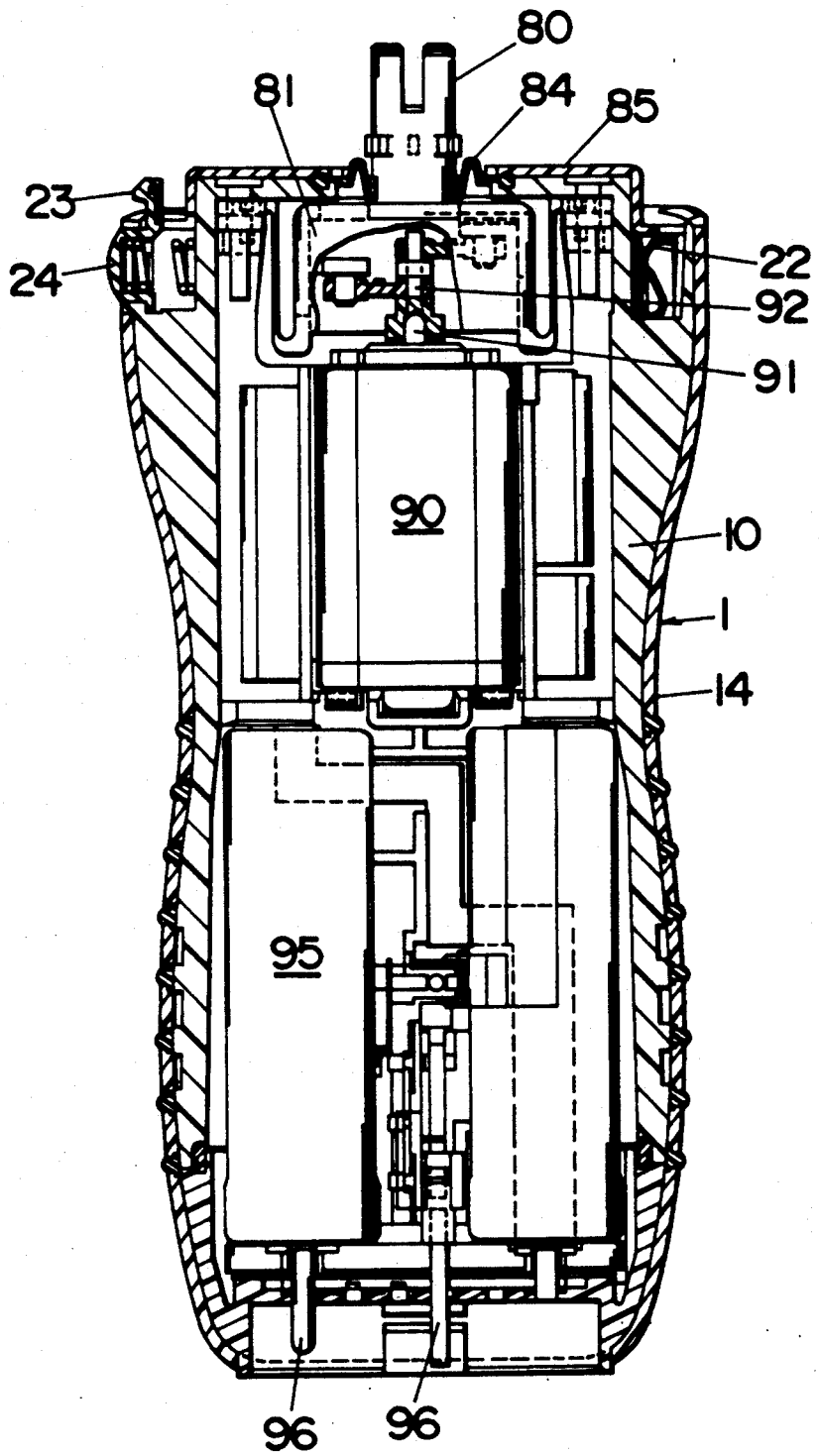
FIG. 4 is a vertical front section of the shaver with a shaving head removed therefrom.
Figure 6:
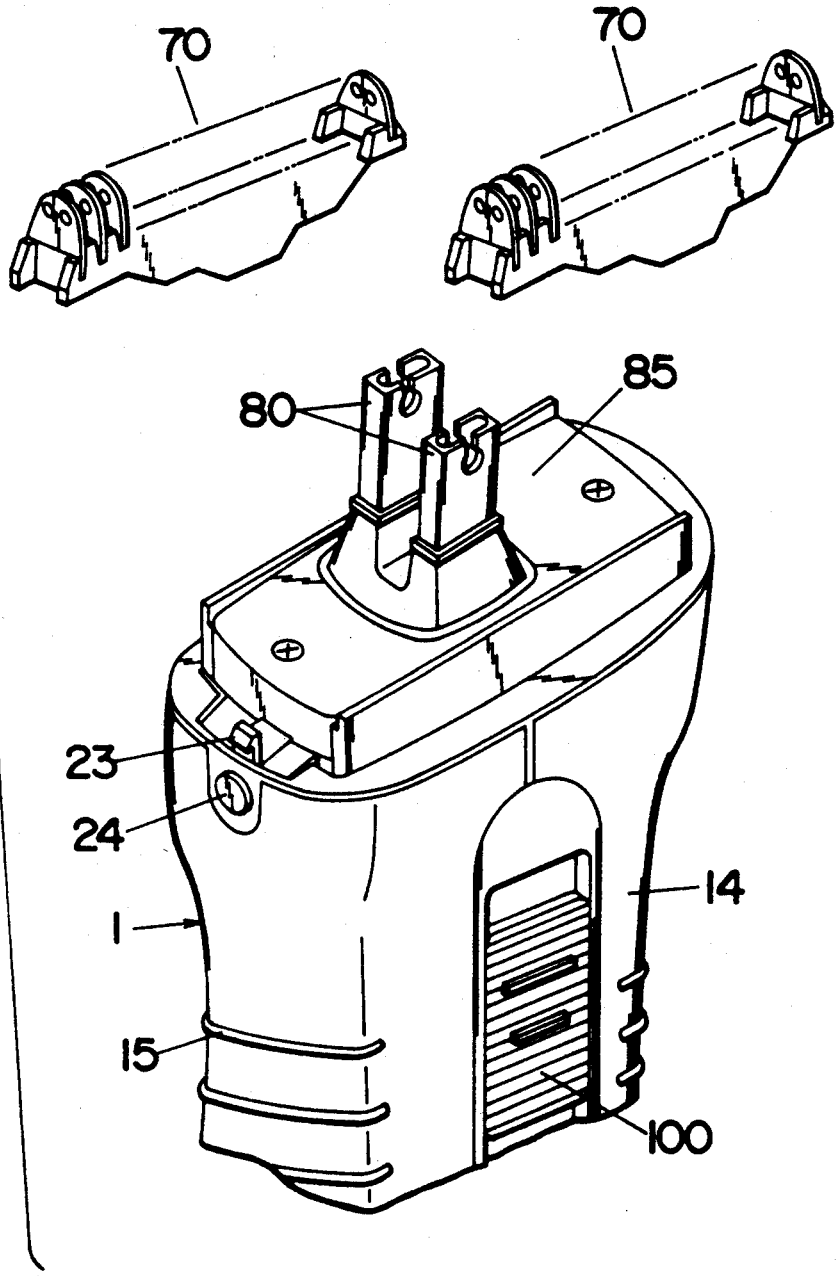
FIG. 6 is an exploded perspective view of the shaver with the shaving head removed.

A corresponding pair of inner cutters 70 project on the top of the housing 1 into hair shearing engagement respectively with the outer shearing foils 58 of the cutter heads 5. As best shown in FIG. 6, the inner cutters 70 each comprising a number of arcuately contoured blades 71 are coupled respectively to reciprocating drive pins so projecting on top of the housing 1 so as to be driven thereby in a counter reciprocating manner. The drive pins 80 are coupled to rotary-to-reciprocation conversion elements 81 which are received within the upper portion of the housing 1 and are driven by an incorporated electric motor 90 to reciprocate in opposite direction to each other for canceling the individual vibrations to achieve dynamic balancing of the inner cutters 70. As shown in FIGS. 3 and 4, the motor 90 has an output shaft 91 connected to a pair of eccentric pins 92 and 93 which are offset by 180° about an axis of the output shaft 91 and coupled to the individual conversion elements 81 such that the rotary motion of the eccentric pins 92 and 93 are converted into the counter reciprocating motion of the elements 81. The drive pins 80 are sealed by a seal member 84 so as to make the housing 1 water-tight. A plate 85 is fitted On top of the housing 1 water-tight. A plate 85 is fitted on top of the motor 90 is energized by an incorporated rechargeable battery 95 having charge terminals 96 projecting through the bottom of the housing 1 for electrical connection to a charger (not shown). These terminals 96 are also sealed to make the housing 1 water-tight so that the shaver can be utilized in wet condition.

The motor 90 is energized and deenergized by an operation of a switch handle 100 slidably mounted on the front face of the housing 1. A trimmer 110 is provided on the rear face of the housing 1 to be utilized independently or in cooperation with the shaver head 2. As shown in FIG. 3, the trimmer 110 comprises a vertically slidable trimmer handle 111 carrying at its upper end a toothed stationary blade 112 and a toothed movable blade 113. The movable blade 113 is supported at the upper end of a pivot lever 114 which is pivoted at its middle to the trimmer handle 111 and is engaged at its lower end to a reciprocating member 115 which extends vertically along the rear face of the housing 1 and is coupled at its upper end to one of the drive pins 80 so that the movable blade 113 is driven by the drive pin 80 through the member 115 and the pivot lever 114 to reciprocate in hair shearing engagement with the stationary blade 112. The trimmer 110 is vertically slidable between a lower off-position of FIG. 3, an intermediate on-position where the blade 112 and 113 are positioned at substantially the same vertical level as the apex of the cutter heads 5 and an upper on-position where the blade 112 and 113 project upwardly above the apex of the cutter heads 5.

Figure 2:
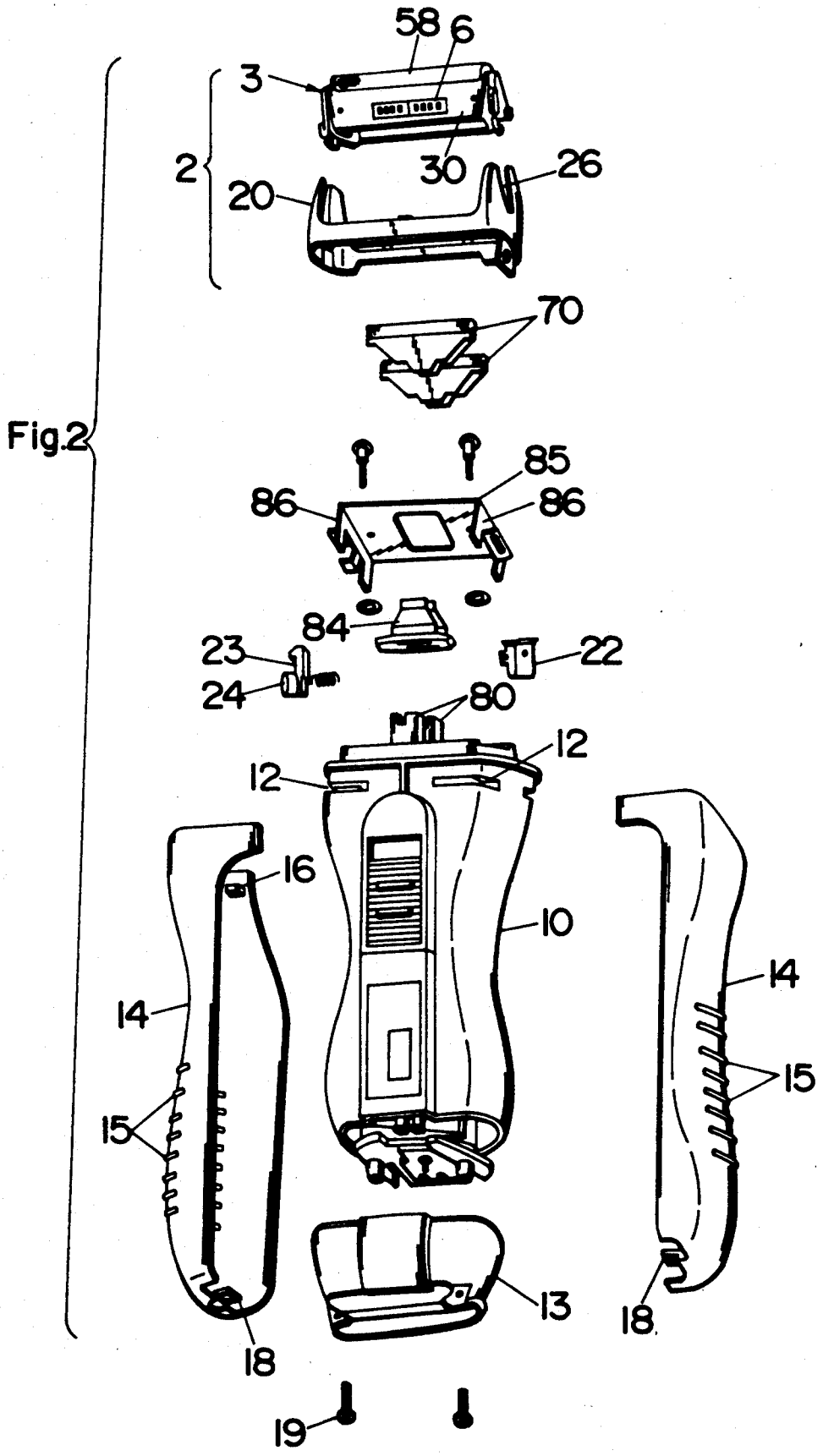
FIG. 2 is an exploded perspective view of the shaver.
Figure 5A:
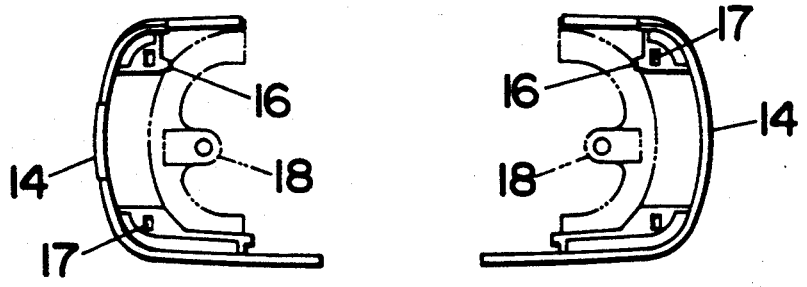
FIGS. 5A to 5C are respectively top, front, and bottom views in exploded representation of outer shells of a shaver housing.
Figure 5B:
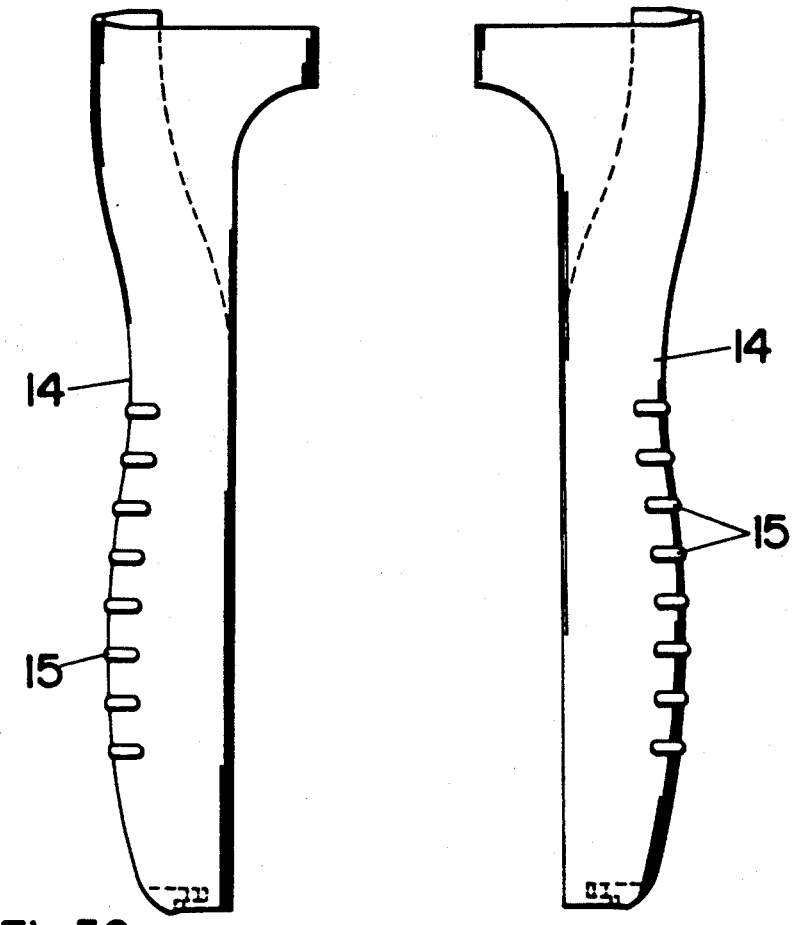
Figure 5C:
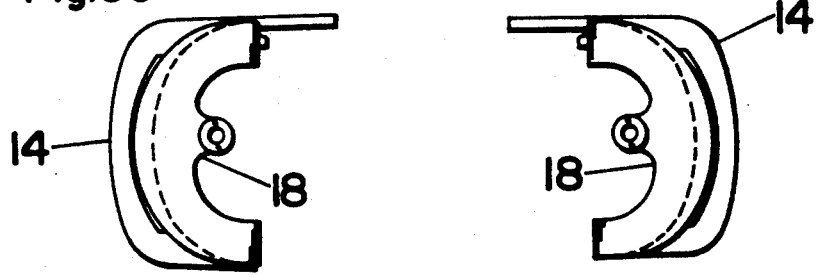

As shown in FIG. 2, the housing 1 is composed of a main body 10, bottom cover 13 and a pair of outer side shells 14 fitted over the opposed side portions of the main body 10 and the bottom cover 13. The outer side shells 14 are molded from a plastic material with metal plating finish having a number of vertically spaced knurls 15 of rubber integrally molded in the shell 14 to permit convenient manual gripping. As shown in FIG. 5A, the outer shells 14 are formed at the respective upper ends with inner projections 16 with individual slots 17 and also formed at the respective lower ends with apertured tabs 18. The inner projections 16 are engaged into corresponding grooves 12 in the upper end of the main body 10 and are secured thereto by mean of legs 86 depending from the plate 85 into the slots 17. The lower end of the outer shells 14 are secured to the bottom cover 13 by means of screws 19 extending through the tabs 18.

Figure 7:
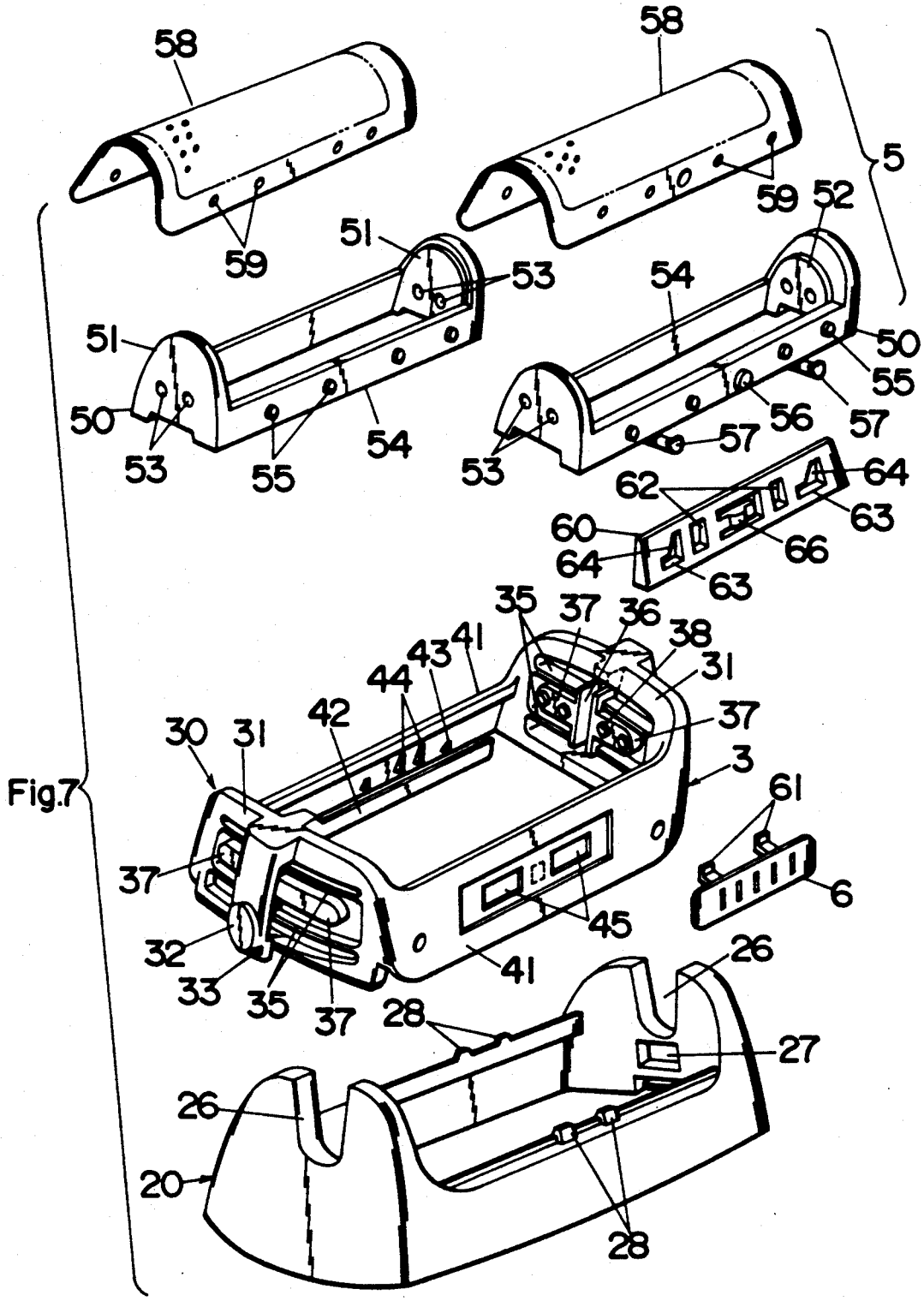
FIG. 7 is an exploded perspective view of the shaving head.

Now referring to FIG. 7, the head frame 3 comprises a rectangular chassis 30 of a plastic material having opposed end walls 31 integrally connected by opposed side walls 41 and a separator rib 42 dividing the interior of the chassis 30 laterally into two openings each receiving each one of the cutter heads 5. Each of the end walls 31 is formed with a knob 32 which is received into a corresponding one of vertical slits 26 in the opposed ends of the support frame 20 with a hook 33 at the lower end of the knob 32 engaged into a dent 27 formed in the ends of the support frame 20 adjacent to the bottom of the slit 26 for mounting of the head frame 3 to the support frame 20. The knobs 32 are given resilient deforming capability to such an extent that when the knob 32 is pressed inward the hooks 33 are disengaged out of the dent 27 for removal of the head frame 3 from the support frame 20. For exact positioning of the head frame 3, the support frame 20 is formed with studs 28 for engagement with projections 43 correspondingly formed on the inner surfaces of the side walls 41 of the chassis 30. The cutter head 5 comprises a rectangular holder 50 molded from a plastic material to have opposed end plates 51 integrally bridged by side bars 54. The outer shearing foil 58 is curved arcuately between the opposed side bars 54 and secured thereto by engagement of posts 55 on the side bars 54 into corresponding apertures 59 in the lateral ends of the shearing foils 56. Each end plate 51 is formed on its inner surface with arcuately contoured guide 52 along which the longitudinal end of the shearing foil 58 is curved. Also, each end plate 51 is provided with holes 53 for connection with the corresponding end wall 31 of the chassis 30. Each side bar 54 is formed on its center with a stud 56 for loose engagement between a pair of guide ribs 44 on the inner surface of the side wall 41 of the chassis 30 in such a manner that the stud 56 is vertically movable between the guide ribs 44. At least one of the holders 50 is formed on the side bar 54 with a pair of longitudinally spaced follower pins 57 for connection with a slider 60 disposed on the interior of one of the side walls 41 of the chassis 30. The slider 60 is connected to a slider handle 6 which is slidable on the exterior of the side wall 41 to be accessible by the user. To this end, the slider handle 6 has a pair of hooks 61 extending through openings 45 in the side wall 41 for engagement with corresponding notches 62 in the slider 60.

Figure 8:
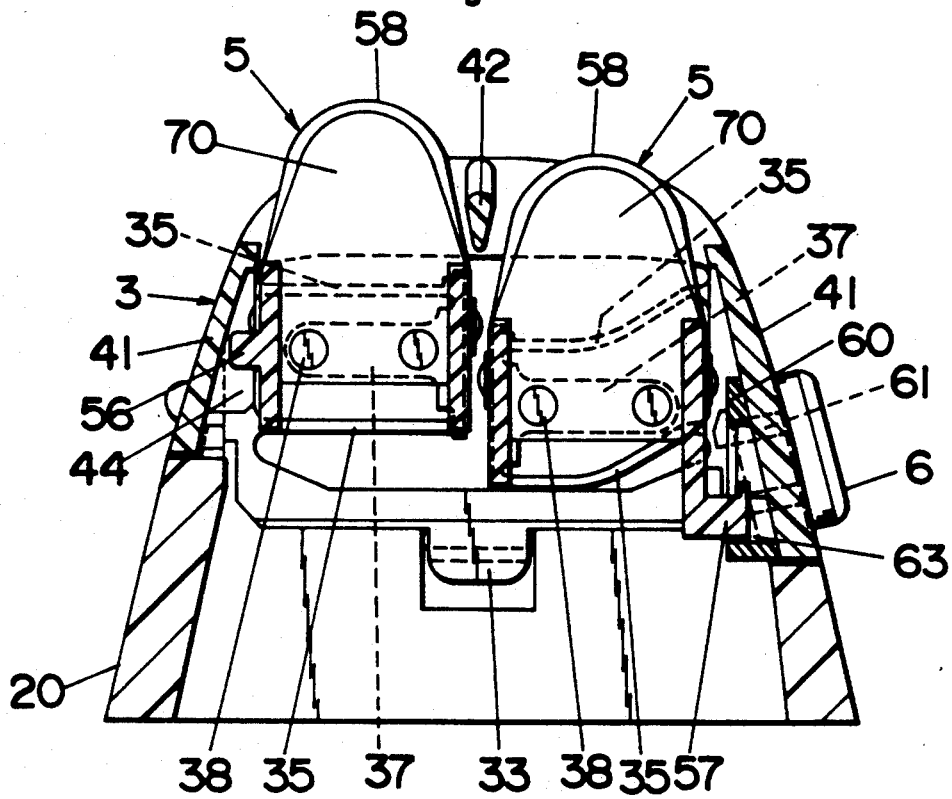
FIG. 8 is an enlarged vertical side section of the shaving head.
Figure 9:
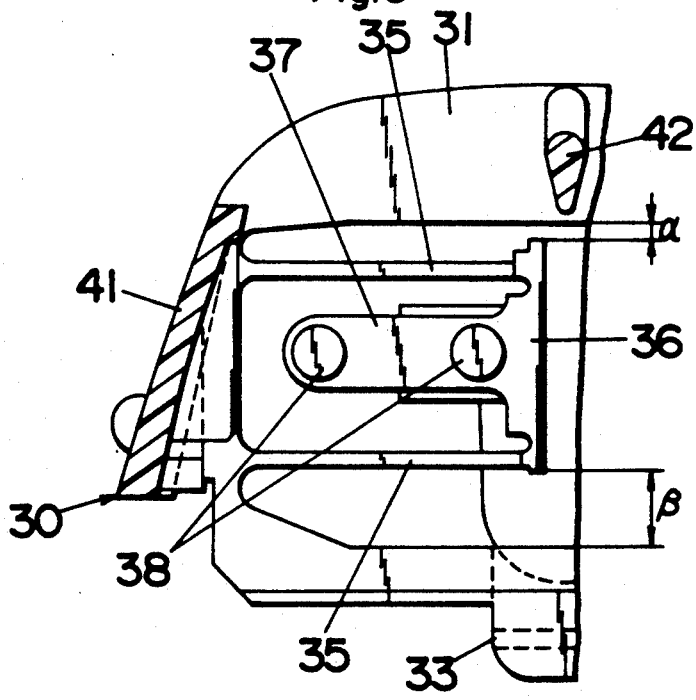
FIG. 9 is a partial vertical side section of the shaving head.
Figure 10:
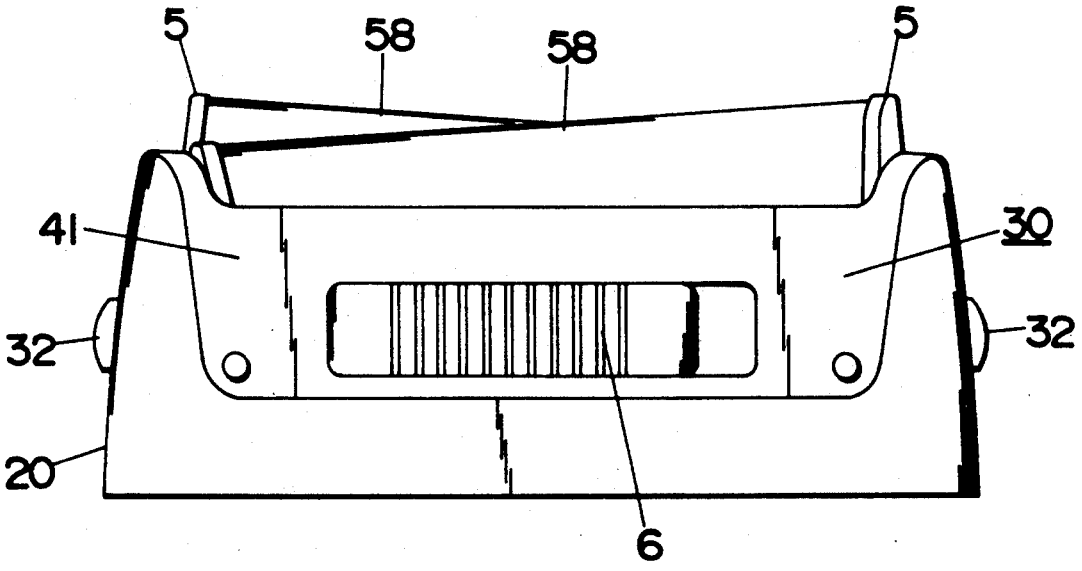

Formed within the thickness of each end wall 31 of the chassis 30 is two pairs of resilient beams 35 extending inwardly and integrally from the lateral ends of the end wall 31, as shown in FIGS. 7 to 9. In each pair, the resilient beams 35 extend in parallel relation and terminate at their free ends into a coupler 36 with a horizontal extension 37 extending towards the lateral end of the end wall 31 between the beams 35 in a generally parallel relation thereto. The beams 35 are made thin enough so as to be resiliently deformable within the thickness of the end wall 31, whereby the horizontal extension 37 is allowed to resiliently move together with the coupler 36 in a vertical plane. Each horizontal extension 37 is provided with a pair of bosses 38 extending inwardly for engagement into the corresponding holes 53 in the end plate 51 of the holder 50 of the cutter head 5. Thus, the horizontal extension 37 is cooperative with the resilient beams 35 to define a spring support member for supporting the corresponding longitudinal end of the cutter head 5 in a floating manner such that the one longitudinal end of the cutter head 5 is resiliently movable vertically substantially independently from the other longitudinal end. With this supporting structure, not only are the two cutter heads 5 allowed to move vertically independently from each other but also is each cutter head 5 allowed to move vertically in different vertical displacements at the two longitudinal ends so that each cutter head 5 can be inclined, as shown in FIG. 10, so as to best conform to the shape of the skin with a maximum skin engaging area.

When the cutter head 5 is subjected to no external pressing force either from the skin or the inner cutter 70, each of the spring support member composed of the beams 35, the coupler 36 and the horizontal extension 37 assumes a neutral position, as shown in FIG. 9, where the beams 35 extends substantially horizontally. The spring support member is permitted to be resiliently displaced upward by a short distance of $\alpha$ and downward by a long distance of $\beta$, as shown in the figure, such that, when the cutter heads 5 is mounted on the housing 1, the cutter heads 5 are displaced upwardly by the distance of $\alpha$ as being urged by the corresponding inner cutters 70. Thus, during the shaving operation of pressing the cutter heads 5 against the skin of the user, the cutter heads 5 are permitted to be resiliently displaced downward by a total distance of $\alpha+\beta$ at either of the longitudinal ends or at its connection to each one of the spring support members. This is advantageous to give a large amount of downward displacement $[\alpha+\beta]$ to the spring support member while effectively alleviating fatigue which the beams 35 suffer during an extended period of use. It is noted here that the inner cutters 70 are biased upwardly by means of springs 82 provided at the connection of the drive pins 80 to the inner cutters 70, respectively.

Figure 11:
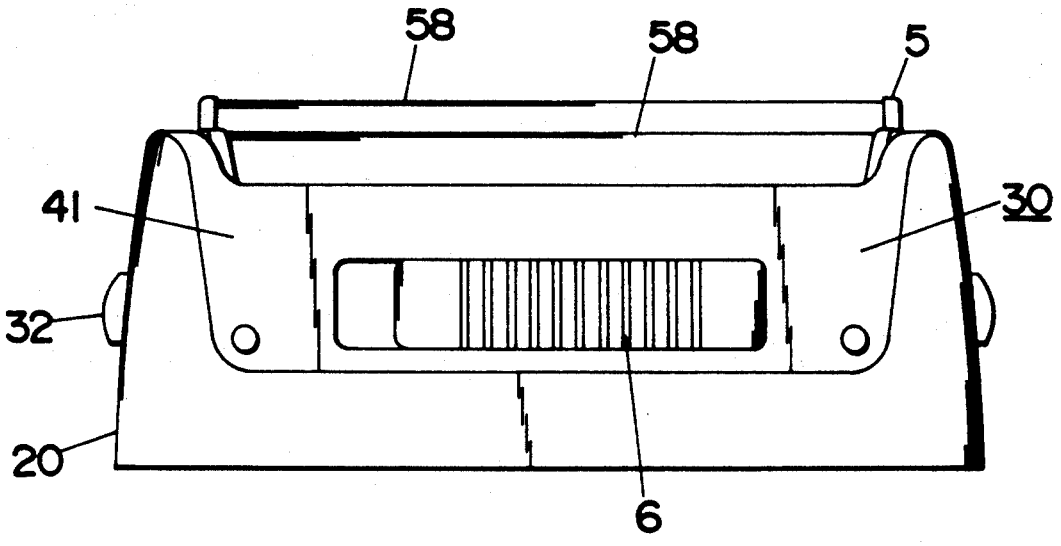
FIGS. 10 and 11 are respectively front views illustrating different operation modes of shaving head.
Figure 12A:
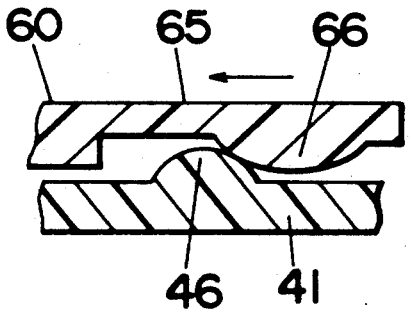
FIGS. 12A and 12B are respectively schematic views illustrating the operation of a slide handle for vertically displacing one cutter head of the shaving head.
Figure 12B:
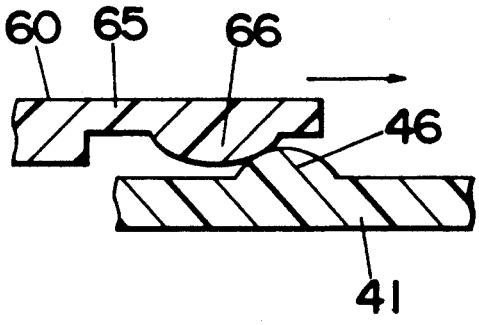

As shown in FIGS. 8 and 11, one of the cutter heads 5 coupled through the slider 60 to the slider handle 6 can be held in a lower vertical position relative to the other cutter head 5 so as to enable only one of the cutter heads 5 while disabling the other for successfully shaving the restricted area, for example, beneath the nose with one cutter head 5 without irritating the upper lip by the other cutter head 5. To this end, the slider 60 has a pair of longitudinally spaced windows 63 having inclined cam edges 64 between two horizontal edges of different vertical levels. The associated cutter head 5 is coupled to the slider 60 with the follower pins 57 projecting into the windows 63, respectively, in slidable contact with a portion including the cam edges 64 and the horizontal edges, such that the cutter head 5 is lowered and raised in response to that the follower pins 57 moves from the one horizontal edge to the other horizontal edge through the cam edge 64 within each window 63 as a result of moving the slider 60 along the length of the side wall 41. In this manner, the sliding movement of the slider 60 is converted to displace the cutter head 5 vertically and the cutter head 5 can be held either at the lower or raised position where each of the follower pins 57 engages the corresponding one of the two horizontal edges. The slider 60 has a rounded projection 66 engaging a corresponding convex 46 on the inner surface of the side wall 41 of the head frame 3, as shown in FIGS. 12A and 12B. When manipulating the slider handle 6 along the length of the side wall 41 to move the slider 60, the projection 66 cams over the convex 46 and is latched therebehind so that the slider 60 is retained in either of two conditions where the associated cutter head 5 is at the lowered position of FIGS. 8 and 11 and at the raised normal position of FIG. 3 in level with the adjacent cutter head 5. It should be noted here that the projection 66 is formed on a cantilever 65 extending horizontally and is capable of flexing by a greater extent at its free end than at the other end, such that the projection 66 is easier to ride over the convex 46 when the slider 60 moves in the direction, as indicated by an arrow of FIG. 12B, to lower the cutter head 5 than when it moves in the direction as indicated by an arrow of FIG. 12A to raise the cutter head 5. In other words, the cutter head 5 can be rendered reluctant to return back into its normal raised position, thereby being prevented from accidentally and unintentionally returning to its normal raised position and therefore avoiding possibility of the disabled cutter head 5 projecting into engagement with a portion to the skin not intended to be shaved.

Figure 13:
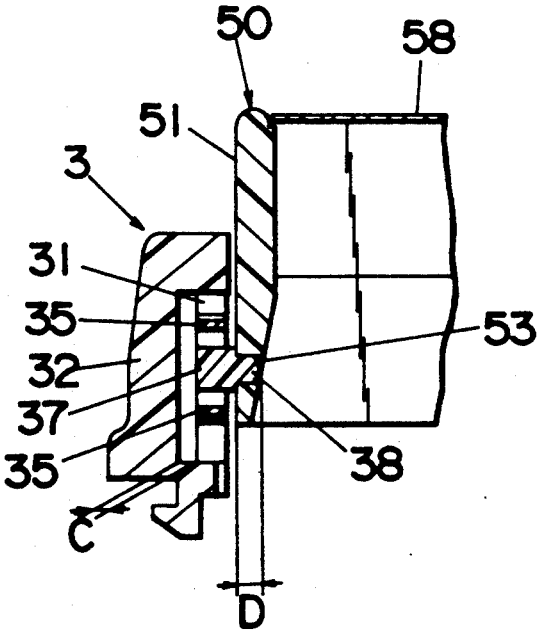
FIG. 13 is a partial sectional view of the cutter head.

As shown in FIG. 13, the holder 50 carrying the outer shearing foil 58 is coupled to the chassis 30 of the head frame 3 by engaging the bosses 38 into the holes 53 by a depth D which is greater than a clearance C afforded between the knob 32 and the horizontal extension 37 which is allowed to flex toward the knob 32 by the resiliency given to the complementary beams 35. Thus, even when an external force is applied to forcibly flex the extension 37 outwardly, the bosses 38 are kept engaged into the holes 53 to prevent accidental detachment of the cutter head 5 from the head frame 3, while the cutter head 5 can be easily assembled to the head frame 3 by flexing the knob 32 outwardly and at the same time flexing the end plate 51 of the holder 50 inwardly.

Figure 14:
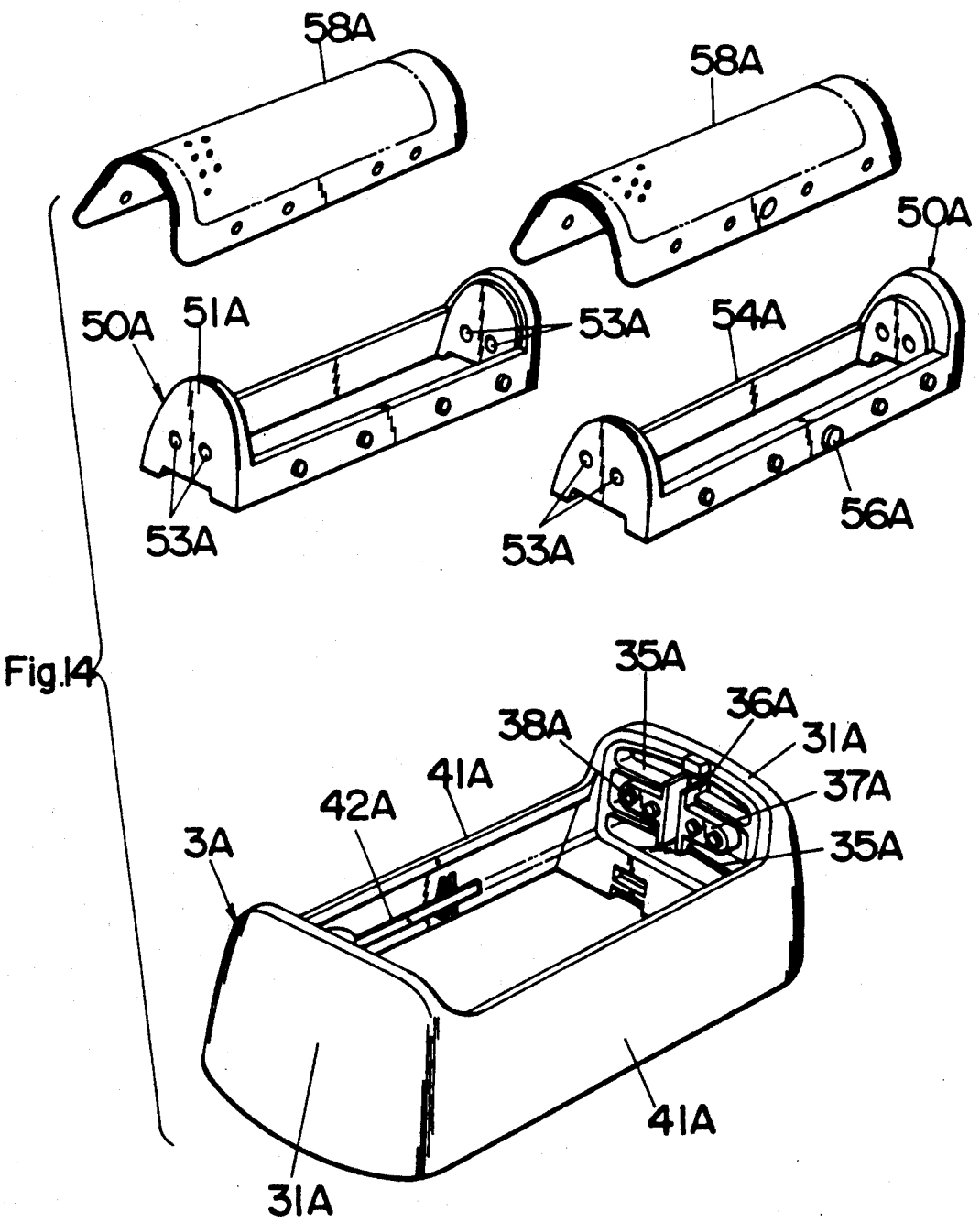
FIG. 14 is an exploded perspective view of a shaving head in accordance with a first modification of the first embodiment.

Although the head frame 3 is shown to be detachably supported to the support frame 20 in the above embodiment, the present invention is not limited thereto and may be so constructed to eliminate the support frame and to mount a head frame 3A directly on the shaver housing instead, as shown in a first modification of FIG. 14. The other structures and operations are identical to the above embodiment and therefore like parts are designated by like numerals with a suffix letter of "A".

Figure 15:
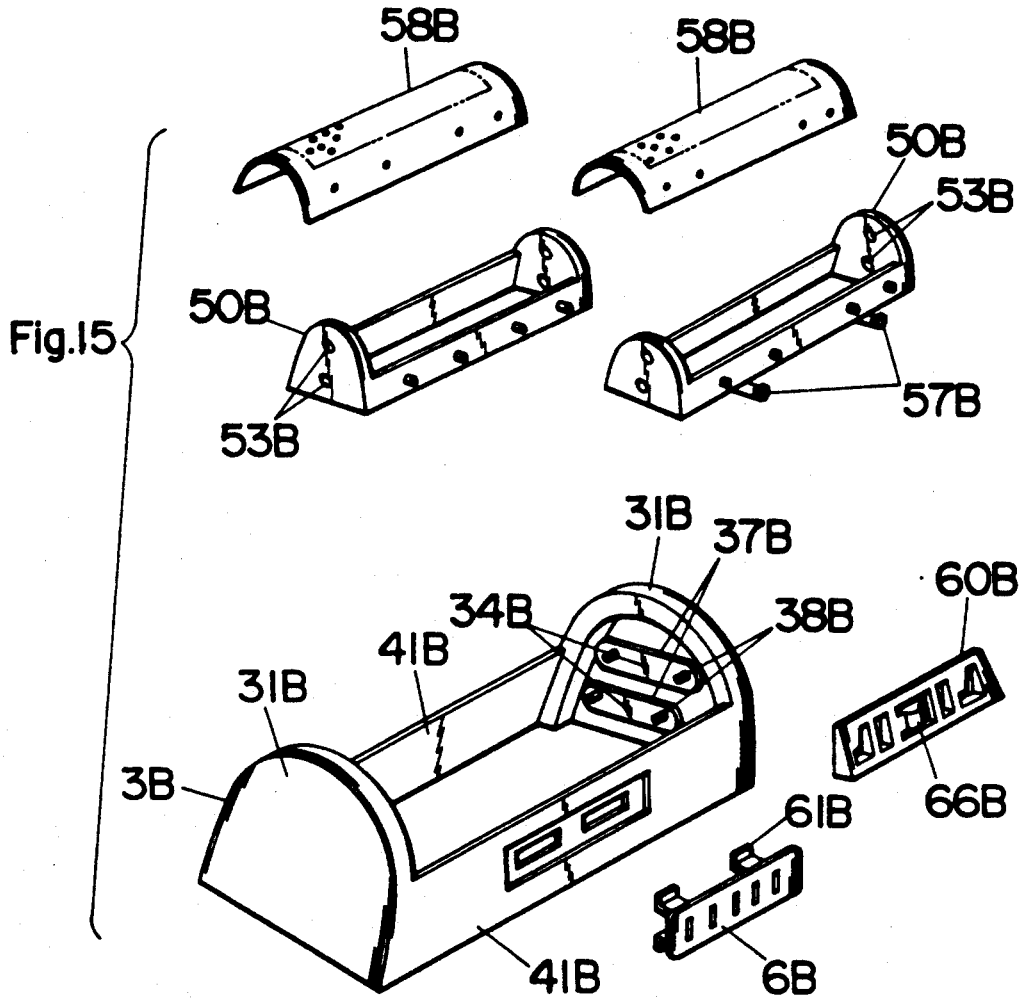
FIG. 15 is an exploded perspective view of a shaving head in accordance with a second modification of the first embodiment.

FIG. 15 illustrates a second modification of the above embodiment which includes a head frame 3B directly mounted on a like shaver housing. The head frame 3B is of rectangular configuration having opposed end walls 31B integrally bridged by side walls 41B. On the inner surface of each end wall 31B there are provided a pair of vertically spaced and horizontally extending swing levers 37B which are centrally supported about respective pivot pins 34B on the end wall 31D and provided with a pair of bosses 38B on the opposite side of the pivot pin 34B. Each cutter head 5B is of identical configuration to that of the above embodiment except that a holder 50B is provided in each of opposed end plate 51B with a vertically spaced holes 53B. Each cutter head 5B is assembled to the head frame 3B in such a manner that each end plate 51B is connected to the upper and lower swing levers 37B by engagement of the corresponding bosses 38B into the vertically spaced holes 53B. One of the cutter head 5B is connected through a slider 60B to a slider handle 6B in the like manner as in the above embodiment so that it is held in a lower vertical position relative to the other cutter head 5B. When the cutter head 5B is lowered, the swing levers 37B are cause to pivot about the pivot pin 34B so as to raise the other cutter head 5B, thereby giving a greater height difference between the two cutter heads 5B than obtained in the above embodiment for increased convenience of shaving the restricted area only by the projecting cutter head 5B. It is noted here that, also in this modification, each cutter head 5B is movable relative to the head frame 3B at one of the longitudinal ends independently from the other longitudinal end.

Figure 16:
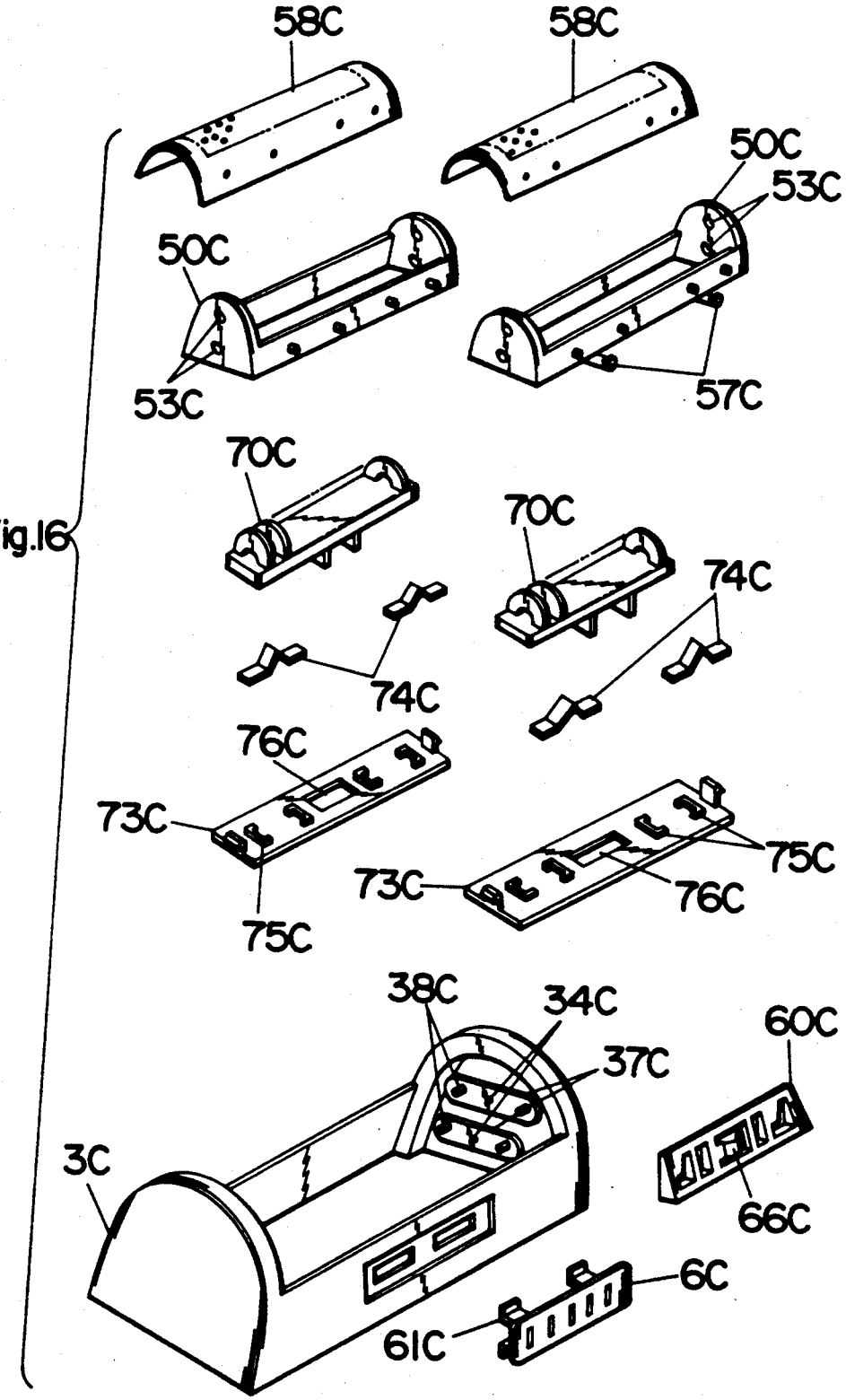
FIG. 16 is an exploded perspective view of a shaving head in accordance with a third modification of the first embodiment.
Figure 17:
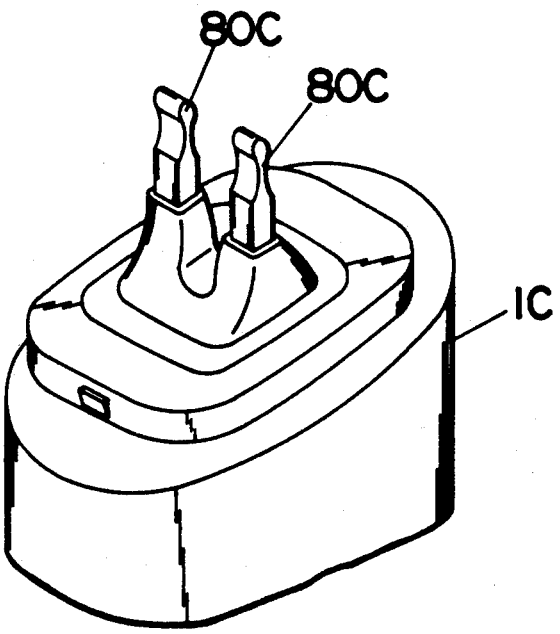
FIG. 17 is a perspective view illustrating a top portion of a housing on which the shaving head of FIG. 16 is mounted.

FIGS. 16 and 17 illustrate a second modification which is identical to the above first modification except that each holder 50C carrying an outer shearing foil 58C is additionally provided with a cover plate 73C carrying a pair of springs 74C. The cover plate 73C is fitted into the bottom of the holder 50C over the bottom of the inner cutter 70C so as to urge the inner cutter 70C upwardly for engagement with the outer shearing foil 58C. Thus, the inner cutter 70C can be urged into pressed contact with the outer shearing foil 57C at substantially a constant pressure irrespective of the changing position of the cutter heads 5C relative to the head frame 3C, assuring a constant shaving operation between the outer shearing foil 58C and the inner cutter 70C. Each spring 74C is secured on the cover plate 73C by means of retainers 75C integrally formed on the cover plate 73C. By providing the springs 74C within the individual cutter heads 5C, no additional springs are necessary on the side of drive pins 80C projecting on the shaver housing 1C in reciprocating connection to the respective inner cutters 70C. The drive pins 80C, as shown in FIG. 17, are allowed to extend through corresponding windows 76C in the cover plates 73C for coupling with the individual inner cutters 70C.

What is claimed is:

1. In a reciprocatory electric shaver comprising:

a head frame mounting more than one elongated cutter head extending horizontally to define a longitudinal axis and having opposed longitudinal ends spaced along said longitudinal axis, each cutter head including an elongated outer shearing foil which comes into hair shearing engagement with an inner cutter driven to reciprocate along said longitudinal axis;

said cutter heads being floatingly supported to said head frame in such a manner than said cutter heads are vertically movable relative to said head frame independently from each other as well as that each of said cutter heads is vertically movable at one of said longitudinal ends substantially independently of the other longitudinal end;

said head frame having opposed end walls spaced along said longitudinal axis, said opposed end walls being formed respectively with spring support members molded integrally therein and which are vertically movable relative to said head frame independently from each other and are coupled to said longitudinal ends of the cutter head in a floatingly supporting relation thereto;

a shaver housing mounting said head frame, a reciprocating element projecting from said housing to driving connect said inner cutter, and a spring means carried by said reciprocating element to floatingly support said cutter heads.

2. A reciprocatory electric shaver as set forth in claim 1 wherein each of said spring support members comprises a plurality of vertically spaced resilient beams extending from the associated end wall in substantially a parallel relation to each other and a coupled which joins the free ends of said resilient beams so that said spring support member is vertically movable relative to the associated end wall by resiliently deforming said resilient beams, said coupled being connected to the corresponding longitudinal end of said cutter head.

3. A reciprocatory electric shaver as set forth in claim 2, wherein said coupler is allowed to resiliently move vertically downward in a greater amount than vertically upward from a standard position where said spring support member is subjected to no substantial external force.

4. A reciprocatory electric shaver as set forth in claim 2, wherein said spring support member is disposed within a thickness of the associated end wall with said coupler connected to said cutter head.

5. A reciprocatory electric shaver as set forth in claim 1, wherein each of said cutter heads includes a holder mounting said outer shearing foil, said holder being coupled to said head frame so as to be floatingly supported thereby.

6. A reciprocatory electric shaver as set forth in claim 1, wherein said head frame is detachably mounted to a support frame which is provided on the top of a shaver housing and into which said inner cutter projects.

7. A reciprocatory electric shaver as set forth in claim 1, further including latch means for holding one of said cutter heads in a lowered position vertically displaced from the adjacent cutter head.

8. A reciprocatory electric shaver as set forth in claim 7, wherein said latch means including a slider supported on the said head frame to be slidable between a first position and a second position, said slider formed with cam means which is engaged with one of said cutter heads in such a manner as to vertically move said one cutter head in response to the sliding movement of said slider from said first position to said second position and hold it into a position vertically displaced from the adjacent cutter head at said second position of said slider.

9. A reciprocatory electric shaver as set forth in claim 8, wherein said cutter heads are provided in a pair and in a parallel relation to each other, only one of said cutter heads being engaged with said cam means in such a manner that it is held thereby into a lower position than the other cutter head, whereby leaving said other cutter head to project above said one cutter head and permitting it to vertically movable relative to said other head cutter head.

10. A reciprocatory electric shaver as set forth in claim 9, further including a trimmer positioned on the same side of said other cutter head.

* * * * *